US005235957A

United States Patent [19]

Furuya

[11] Patent Number: 5,235,957

[45] Date of Patent: Aug. 17, 1993

[54] DIAGNOSING DEVICE AND DIAGNOSING METHOD IN AIR/FUEL RATIO CONTROL DEVICE FOR INTERNAL COMBUSTION ENGINE

[75] Inventor: Junichi Furuya, Isesaki, Japan

[73] Assignee: Japan Electronic Control Systems Co., Ltd., Isesaki, Japan

[21] Appl. No.: 971,634

[22] Filed: Nov. 5, 1992

[30] Foreign Application Priority Data

Nov. 5, 1991 [JP] Japan ..... 3-288641

[51] Int. Cl.[5] ..... F02D 41/14

[52] U.S. Cl. ..... 123/688

[58] Field of Search ..... 123/688, 690

[56] References Cited

U.S. PATENT DOCUMENTS 4,208,993 6/1980 Peter ..... 123/688
4,512,313 4/1985 Tsuchida et al. ..... 123/688
4,638,658 1/1987 Otobe ..... 123/688 X
4,844,038 7/1989 Yamato et al. ..... 123/688 X

FOREIGN PATENT DOCUMENTS 60-240840 11/1985 Japan .
62-78444 4/1987 Japan .

*Primary Examiner*—Willis R. Wolfe
*Attorney, Agent, or Firm*—Foley & Lardner

[57] ABSTRACT

In a device for feedback control of an air/fuel ratio using an oxygen sensor for detecting oxygen concentration in exhaust gas, two different reference levels for diagnosis are set according to a detection signal level of the above oxygen sensor. And a response time with which the detection signal of the oxygen sensor crosses the above reference levels for diagnosis is measured so as to diagnose deterioration of the oxygen sensor based on comparison between the above measured response time and a predetermined response time.

12 Claims, 12 Drawing Sheets

DIAGNOSING DEVICE AND DIAGNOSING METHOD IN AIR/FUEL RATIO CONTROL DEVICE FOR INTERNAL COMBUSTION ENGINE

BACKGROUND OF THE INVENTION (1) Field of the Invention

The present invention relates to, in an air/fuel ratio control device for an internal combustion engine for feedback control of an air/fuel ratio of mixture sucked into an engine based on oxygen concentration in exhaust gas detected by an oxygen sensor, a method for diagnosing deterioration in the above oxygen sensor.

(2) Related Art of the Invention

The following device is known as a fuel supply control device for an engine having a feedback control function for an air/fuel ratio.

That is, and oxygen sensor for outputting a detection signal at a level corresponding to oxygen concentration in exhaust gas is provided in an exhaust system of an engine, and it is judged whether an actual air/fuel ratio is richer or leaner than a target air/fuel ratio by comparing the detection signal from the above oxygen sensor with a reference level corresponding to the target air/fuel ratio. And an air/fuel ratio feedback correction coefficient for multiplying a basic fuel supply amount calculated from a detection result of an intake air amount is controlled in the direction where the actual air/fuel ratio gets close to the target air/fuel ratio based on the above rich/lean judgement so that the target air/fuel ratio is stably obtained (See Japanese Unexamined Patent Publication No. 60-240840).

In the meantime, with such a device that carries out the above air/fuel ratio feedback control as above, when the oxygen sensor deteriorates and its output characteristic changes, even if the feedback control is carried out toward the target air/fuel ratio on control, the actual air/fuel ratio is deviated from the target air/fuel ratio, which makes a problem.

Then, a device for diagnosing deterioration of the oxygen sensor has been proposed such as a device which measures a cycle of the detection signal of the oxygen sensor during the air/fuel feedback control and diagnoses deterioration of the oxygen sensor (deterioration in response speed) based on changed in this cycle.

However, with the above deterioration diagnosis based on the detection signal cycle, the cycle might be changed by the causes other than deterioration in response in the oxygen sensor such as increase in valve deposit or change in fuel wall flow rate changed by intake manifold temperature or carburetion of fuel, which leads to the problem that high diagnosing accuracy is hard to be maintained.

In this respect, a device, as disclosed in the Japanese Unexamined Patent Publication NO. 62-78444, which diagnoses response of the oxygen sensor by measuring a time interval (response time) with which an actual detection signal crosses two reference detection signals is not hardly affected by change in the above valve deposit or fuel wall flow rate, and diagnosing accuracy is secured.

However, in order to measure the time when the reference detection signals are crossed with high accuracy, it is necessary to set the interval between the reference detection signals wide enough to lengthen the time to be measured, but when the oxygen sensor deteriorates, amplitude of not only the response but of the oxygen sensor output might be reduced, which makes it necessary to set the interval between the above reference detection signals narrower to surely measure the response time even if the amplitude of the output is reduced, and it was difficult to surely measure the response time and moreover, with high accuracy.

SUMMARY OF THE INVENTION

The present invention was made in view of the aforementioned problems, and the object of the present invention is, in a device for diagnosing deterioration of an oxygen sensor according to a response time measured based on two reference levels, to measure the response time surely based on the two reference levels even if amplitude of a detection signal is changed by deterioration of the oxygen sensor.

Another object of the present invention is to ensure accuracy of time measurement by enabling setting of the interval between the above two reference levels as wide as possible.

Still another object of the present invention is to improve accuracy of deterioration diagnosis of the oxygen sensor based on the measured response time.

In order to achieve the above object, with respect to a diagnosing device and a diagnosing method in an air/fuel ratio control device for an internal combustion engine according to the present invention, a fuel supply amount to the engine is feedback-controlled so that an air/fuel ratio of intake air/fuel mixture in exhaust gas of the engine gets close to a target air/fuel ratio, while two different reference levels for measuring a response time of the above oxygen sensor are variably set based on a detection signal level of the above oxygen sensor, and the response time with which the detection signal from the above oxygen sensor crosses the above two reference levels for diagnosis is measured so as to make a deterioration diagnosis of the oxygen sensor based on comparison between the above measured response time and a predetermined reference time.

With such constitution, response deterioration of the oxygen sensor is diagnosed based on the time interval with which the detection signal of the oxygen sensor crosses the two detection signal levels for diagnosis, but the above two detection signal levels for diagnosis is not fixed values but variably set according to the detection signal level of the oxygen sensor. Thus, when the detection signal level of the oxygen sensor is changed by deterioration, the detection signal levels for diagnosis are changed following it, which enables measurement of the response time based on the optimum diagnosis level according to the detection signal level.

The above two reference levels for diagnosis may be set so that they detect a maximum value and a minimum value of the detection signal output of the oxygen sensor and calculate amplitude of the detection signal as a deviation between the above maximum value and minimum value, while a value obtained by subtracting a predetermined proportion of the above amplitude from the above detected maximum value is set as a reference level for diagnosis on an upper side and a value obtained by adding a predetermined proportion of the above amplitude to the above detected minimum value as the reference level for diagnosis on a lower side.

As mentioned above, when the reference levels for diagnosis are set from the maximum value and minimum value of the detection signal, the two different reference levels for diagnosis can be set with a large interval within the amplitude of the detection signal.

Also, in measuring the above response time, it may be so constituted that the response time is measured according to direction which the detection signal of the above oxygen sensor crosses the above two reference levels for diagnosis so as to make a deterioration diagnosis of the oxygen sensor based on combination of these response times.

By this, even if response characteristics are varied depending on the change direction of the air/fuel ratio, deterioration of the oxygen sensor can be diagnosed with high accuracy.

Also, it may be so constituted that the above measured response time is corrected according to the ratio of the interval between the above two reference levels for diagnosis against the reference interval so as to make a deterioration diagnosis of the above oxygen sensor based on the response time after the above correction.

As the above two reference levels for diagnosis are variably set according to the detection signal level of the oxygen sensor and the interval between them is changed, it is necessary to judge change in the response time taking into account of the above interval. Then, diagnosis of deterioration by comparison with a certain reference time was made possible by correcting the response time according to the ratio of the interval between the above two reference levels for diagnosis against the reference interval.

Also, it is desirable to measure a control cycle in the feedback control of the above fuel supply amount and to carry out judgment on generation of deterioration in the oxygen sensor only when both the above measured control cycle and the above measured response time show deterioration in the above oxygen sensor.

As mentioned above, diagnosis accuracy can be further improved by making a deterioration diagnosis of the oxygen sensor not only by the response time but also using the cycle of the air/fuel ratio feedback control as a parameter.

Moreover, it is desirable not to measure the above response time when the detection signal of the above oxygen sensor goes up and down within the above two reference levels for diagnosis.

When the detection signal of the above oxygen sensor goes up and down within the above two reference levels for diagnosis, the response time might by measured as unreasonably long time and deterioration of the oxygen sensor might be misjudged, and the misjudgment is prevented by not carrying out measurement of the response time as mentioned above.

Other objects of the present invention will be made clear by the following explanation on the preferred embodiments referring to the attached drawings.

PREFERRED EMBODIMENTS

A preferred embodiment of a diagnosing device and a diagnosing method in an air/fuel ratio control device for an internal combustion engine according to the present invention is shown in FIG. 1 to FIG. 13.

Figure 2:
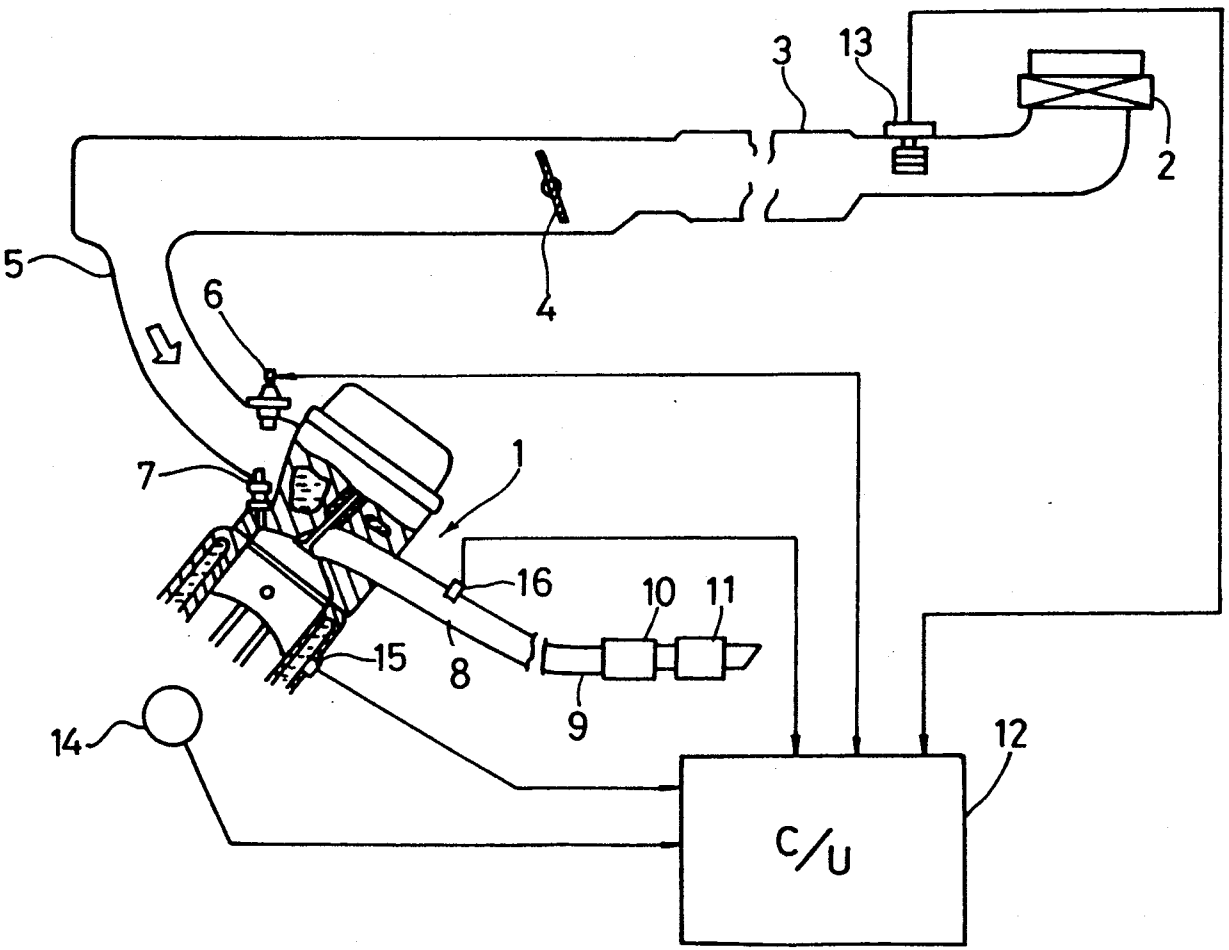
FIG. 2 is a schematic system diagram of an internal combustion engine in a preferred embodiment.

In FIG. 2 showing the system constitution of one preferred embodiment, air is sucked into an internal combustion engine 1 from an air cleaner 2 through an intake duct 3, a throttle valve 4 and an intake manifold 5. Each of branch parts of the intake manifold 5 is provided with a fuel injection valve 6 for each cylinder. This fuel injection valve 6 is an electromagnetic fuel injection valve opened by electric current of a solenoid and closed by stoppage of the electric current, and is opened by the electric current of a driving pulse signal from a control unit 12, which will be described later, and intermittently injects and supplies to the engine 1 fuel press-fed from a fuel pump, not shown, and regulated to a predetermined pressure by a pressure regulator.

An ignition plug 7 is provided at each combustion chamber of the engine 1 to be spark-ignited so as to ignite and burn mixture. And exhaust gas is exhausted from the engine 1 through an exhaust manifold 8, an exhaust duct 9, a catalytic converter rhodium 10 and muffler 11.

The control unit 12 is provided with a micro computer comprising CPU, ROM, RAM, an A/D converter and an input/output interface, and receives input signals from various sensors so as to control action of the fuel injection valve 6 after processing, which will be described later.

As one of the above various sensors, an air flow meter 13 is provided in the intake duct 3 for outputting a signal corresponding to an intake air flow rate Q of the engine 1.

Also, a crank angle sensor 14 is provided for outputting a pulse signal synchronized with the engine revolution. Here, by measuring a cycle of the above pulse signal or the number of generation of the above pulse signals within a predetermined time, an engine revolution speed N can be calculated.

Also, a water temperature sensor 15 is provided for detecting a cooling water temperature Tw of a water jacket of the engine 1.

Also, an oxygen sensor 16 is provided at a collection part of the exhaust manifold 8 for detecting an air/fuel ratio of the intake mixture through oxygen concentration in the exhaust gas. The above oxygen sensor 16 is a known rich/lean sensor which detects the rich/lean state of an actual air/fuel ratio against a theoretical air/fuel ratio using a rapid change in the oxygen concentration in the exhaust gas on the border of the theoretical air/fuel ratio (target air/fuel ratio in this preferred embodiment), and in this preferred embodiment, outputs a high voltage signal around 1V when the air/fuel ratio is richer than the theoretical air/fuel ratio, while conversely, it outputs a low voltage signal around 10B when the air/fuel ratio is lean.

Figure 3:
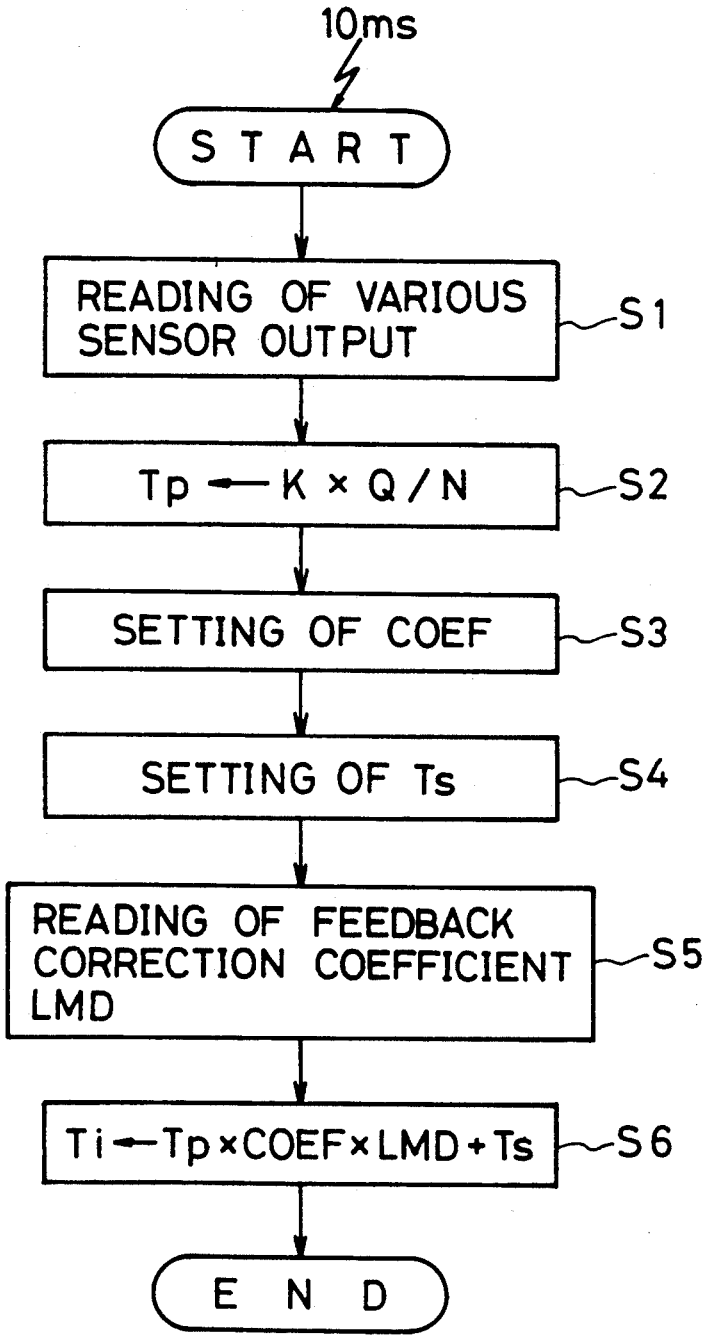
FIG. 3 is a flowchart showing fuel injection amount control.
Figure 4:
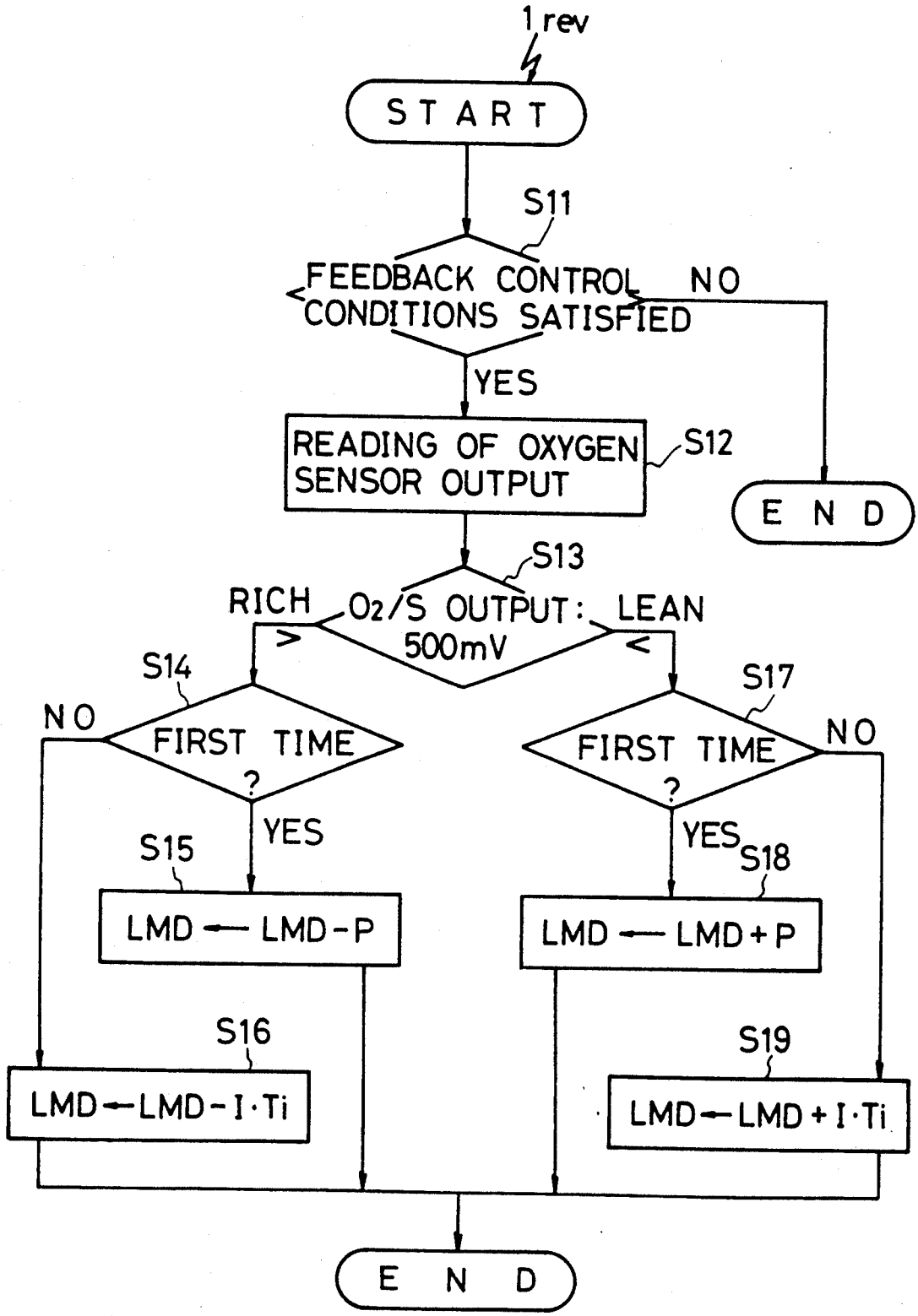
FIG. 4 is a flowchart showing air/fuel ratio feedback control.

Here, the CPU of the micro computer built in the control unit 12 executes processing according to a program on the ROM shown in flowcharts of FIG. 3 and FIG. 4 and sets an air/fuel ratio feedback correction coefficient LMD, while it calculates a fuel injection amount Ti (fuel supply amount) using the above air/fuel ratio feedback correction coefficient LMD, outputs a driving pulse signal of the pulse width corresponding to this fuel injection amount Ti to the fuel injection valve 6 with a predetermined timing synchronized with the engine revolution and electronically controls fuel supply to the engine.

In this preferred embodiment, the control unit 12 is provided with a function as an air/fuel ratio feedback control means (See FIG. 1) in the software manner as shown in the flowcharts of FIG. 3 and FIG. 4.

A program shown in the flowchart of FIG. 3 is executed per predetermined micro time, and at Step 1 (shown as S1 in FIGURE. The same applies to the remainder), the detection signals from the various sensors are read.

And at Step 2, a basic fuel injection amount Tp corresponding to a cylinder intake air amount is calculated based on detected values of the intake air flow rate Q and the engine revolution speed N ($TP \leftarrow K \times Q/N$; K is a constant).

At step 3, various correction coefficients COEF consisting of an enrichment correction coefficient based on a water temperature and an acceleration state and so on is calculated.

At step 4, a correction amount Ts is calculated for correcting change in effective injection time of the fuel injection valve 6 caused by change in battery voltage.

At Step 5, the air/fuel feedback correction coefficient LMD which is set according to the program shown in the flowchart of FIG. 4, which will be described later, is read.

And at Step 6, the final fuel injection amount Ti is calculated by correcting the basic fuel injection amount Tp with the above various correction coefficient COEF, the voltage correction amount Ts and the air/fuel ratio feedback correction coefficient LMD.

The program shown in the flowchart of FIG. 4 is a program to set the above air/fuel ratio feedback correction coefficient LMD by proportional and integral control and carried out per revolution (1 rev) of the engine 1.

First, at Step 11, it is judged whether conditions to feedback control the actual air/fuel ratio to the theoretical air/fuel ratio, which is the target air/fuel ratio, are satisfied or not. When combustion with the air/fuel ratio richer than the theoretical air/fuel ratio is desired at a high load of the engine, cooling down or starting, for example, the air/fuel ratio feedback control to the theoretical air/fuel ratio is not carried out and the air/fuel ratio feedback correction coefficient LMD is clamped, and moreover, the feedback control is basically brought into open control at idle driving in order to ensure driving stability at the idle driving.

When it is judged that the conditions for the air/fuel ratio feedback control are satisfied at Step 11, it goes to Step 12, wherein the voltage signal (detection signal) output from the oxygen sensor ($O_2$/S) 16 corresponding to the oxygen concentration in the exhaust gas is read.

And At Step 13, the voltage signal from the oxygen sensor 16 which was read at Step 12 is compared with a reference level corresponding to the target air/fuel ratio (theoretical air/fuel ratio) (for example, 500 mV, an intermediate value between rich output and lean output).

When it is judged that the voltage signal from the oxygen sensor 16 is larger than the reference level and the air/fuel ratio is richer than the theoretical air/fuel ratio, it goes to Step 14, wherein it is judged whether this judgment as rich is made for the first time or not.

When the rich judgment is the first time, it goes to Step 15, wherein decrease control of the correction coefficient LMD is executed by subtracting a predetermined proportional constant P from the correction coefficient LMD till the last time.

In the meantime, when it is judged at Step 14 that the rich judgment is not the first time, it goes to Step 16, wherein the correction coefficient LMD is renewed by subtracting a value obtained by multiplying the latest fuel injection amount Ti by an integral constant I from the correction coefficient LMD till the last time.

Also, when it is judged at Step 13 that the voltage signal from the oxygen sensor 16 is smaller than the reference level and the air/fuel ratio is leaner than the target, first, similarly as with the rich judgment, it is judged at Step 17 whether this lean judgment is made for the first time or not, and if the first time, it goes to Step 18, wherein increase correction is carried out for the fuel injection amount Ti by renewing the correction coefficient LMD till the last time by adding the proportional constant P to it.

When it is judged at Step 17 that the lean judgment is not the first time, it goes to Step 19, wherein the value obtained by multiplying the latest fuel injection amount Ti by the integral constant I is added to the correction coefficient LMD till the last time so as to gradually increase the correction coefficient LMD.

In this way, the air/fuel ratio feedback correction coefficient LMD is increasingly or decreasingly set by the proportional and integral control in the direction where the actual air/fuel ratio gets close to the target air/fuel ratio (theoretical air/fuel ratio), and by correcting the basic fuel injection amount Tp by this air/fuel ratio feedback correction coefficient LMD, the air/fuel ratio of the engine intake mixture is adjusted.

Next, process of deterioration diagnosis of the above oxygen sensor carried out according to the program shown in flowcharts of FIG. 5 to FIG. 10 will be hereinafter described.

Figure 11:
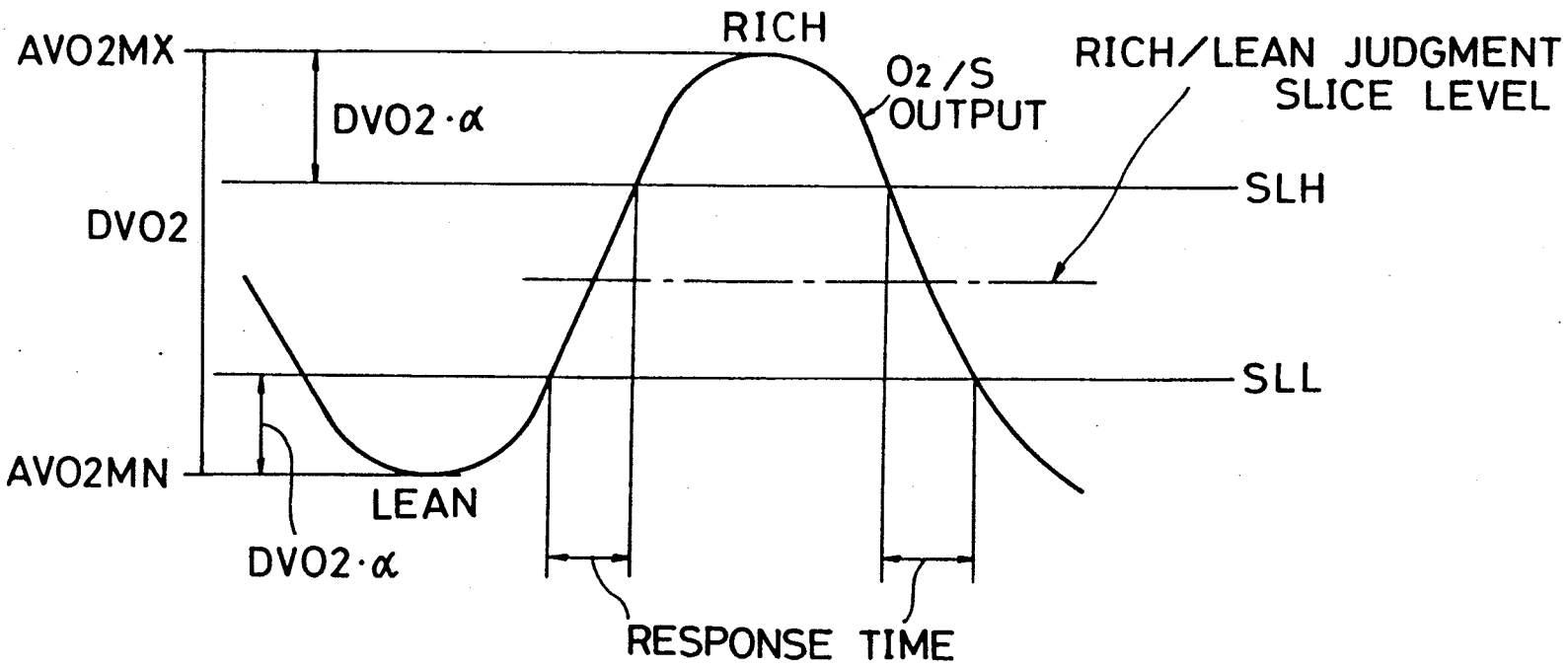
FIG. 11 is a timechart showing characteristics of a reference level for diagnosis.

Outline of the deterioration diagnosis in this preferred embodiment is as follows: As shown in FIG. 11, a time interval with which output voltage of the oxygen sensor 16 crosses two reference levels SLH and SLL for diagnosis, different in voltage level, during the air/fuel ratio feedback control is measured as a response time of the oxygen sensor 16 at reversion of rich/lean of the air/fuel ratio, and when this response time becomes longer than a predetermined time, generation of deterioration response of the oxygen sensor 16 is diagnosed.

In this preferred embodiment, as shown in the flowcharts of FIG. 5 to FIG. 10, the control unit 12 is provided with a function as a diagnosis level variably setting means and a diagnosing means (See FIG. 1) in the software manner.

Figure 1:
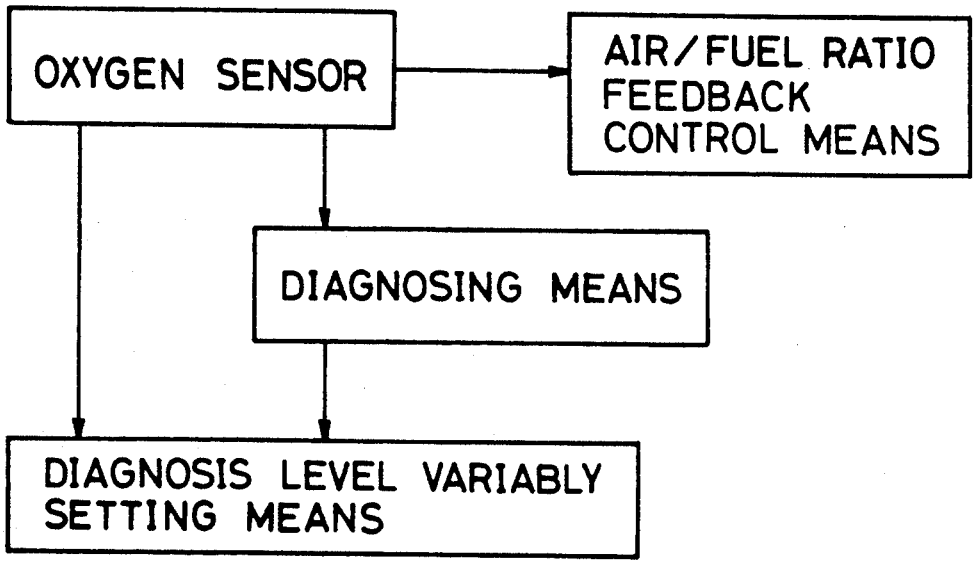
FIG. 1 is a block diagram showing the basic constitution of a diagnosing device according to the present invention.
Figure 5:
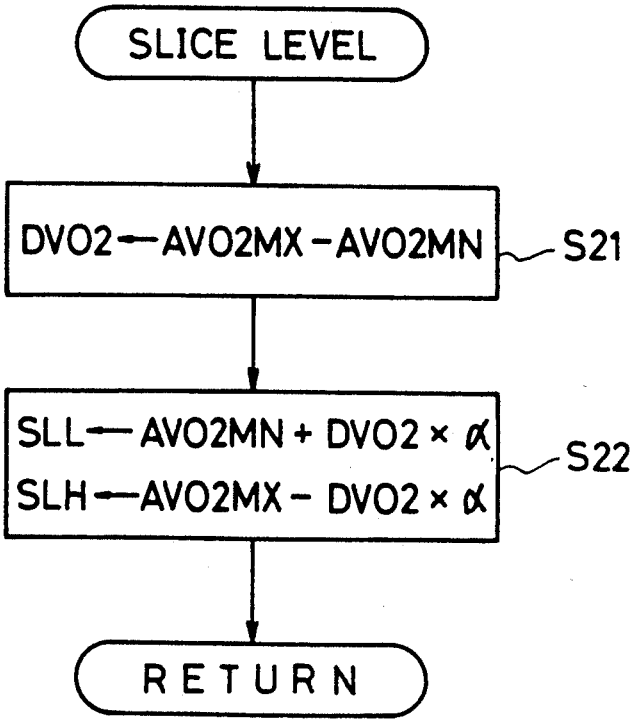
FIG. 5 is a flowchart showing setting control of a reference level for diagnosis.

The program shown in the flowchart of FIG. 5 is to variably set the above reference levels SLH and SLL for diagnosis according to the output amplitude of the oxygen sensor 16. The function shown in the flowchart of FIG. 5 corresponds to a maximum/minimum value detecting means, an amplitude calculating means and a diagnosis level calculating means.

In the flowchart of FIG. 5, first, at Step 21, a deviation between a maximum output average value AVO2MX and a minimum output average value AVO2MN of the oxygen sensor 16 detected during the air/fuel ratio feedback control is obtained and set as an output deviation DVO2 of the oxygen sensor 16.

And at Step 22, an offset amount obtained by multiplying the above output deviation DVO2 by a predetermined value $\alpha$ ($=DVO2\times\alpha$) is subtracted from the above maximum output average value AVO2MX so as to set the reference level SLH for diagnosis on the upper side, while the above offset amount is added to the above minimum output average value AVO2MN so as to set the reference level SLL for diagnosis on the lower side.

In this way, when the reference levels SLH and SLL for diagnosis are variably set according to the actual sensor output level, even if the output deviation DVO2 is decreased due to deterioration in the sensor, the two reference levels SLH and SLL for diagnosis can be set within the output deviation DVO2, whereby measurement of the response time, which will be described later, can be surely executed.

Also, in the light of desirability to set the interval between the above reference levels SLH and SLL for diagnosis as wide as possible in order to ensure accuracy of time measurement, when the reference levels SLH and SLL are set variably according to the output deviation DVO2 as mentioned above, it is possible to set the reference levels SLH and SLL with an interval as wide as possible within the output deviation DVO2.

Next, according to the flowcharts of FIG. 6 to FIG. 8, measurement of the response time of the oxygen sensor 16 carried out using the above reference levels SLH and SLL for diagnosis during the air/fuel ratio feedback control will be hereinafter described.

At Step 31, an output VO2 of the oxygen sensor 16 is compared with the above reference levels SLH and SLL for diagnosis.

When it is judged that the output VO2 is smaller than the lower reference level SLL, it goes on to Step 32.

At Step 32, judgment is made on a flag 'MONTST' showing whether response monitor is being carried out or not. As the above flag 'MONTST' is set at 1 when the output VO2 is within the output range surrounded by the reference levels SLH and SLL, when the output VO2 falls below the reference level SLL for the first time from the state where it is lager than the reference level SLL, it is judged that the flag 'MONTST'=1 at the above Step 32.

When the flag 'MONTST'=1, it goes on to Step 33, wherein judgment is made on a flag 'LEVELO2' showing the history that the output VO2 has gone up and down beyond the reference levels SLH and SLL. When it is judged that the flag 'LEVELO2' is 1, it shows that the output VO2 falls below the reference level SLL from the state where it exceeds the reference level SLH, which means, in this case, that the air/fuel ratio is changed from the rich state to the lean state and the two reference levels SLH and SLL are crossed, and it goes on to Step 34.

At Step 34, by correcting the measurement result of the time required for the output of the oxygen sensor 16 to cross the reference levels SLH and SLL according to the interval between the reference levels SLH and SLL, change in the response time is diagnosed by comparison with a certain reference time.

That is, in this preferred embodiment, as the above reference levels SLH and SLL are variably set according to the sensor output, comparison with the certain reference time is made possible as with the case that the response time is measured based on the certain reference levels SLH and SLL.

Figure 9:
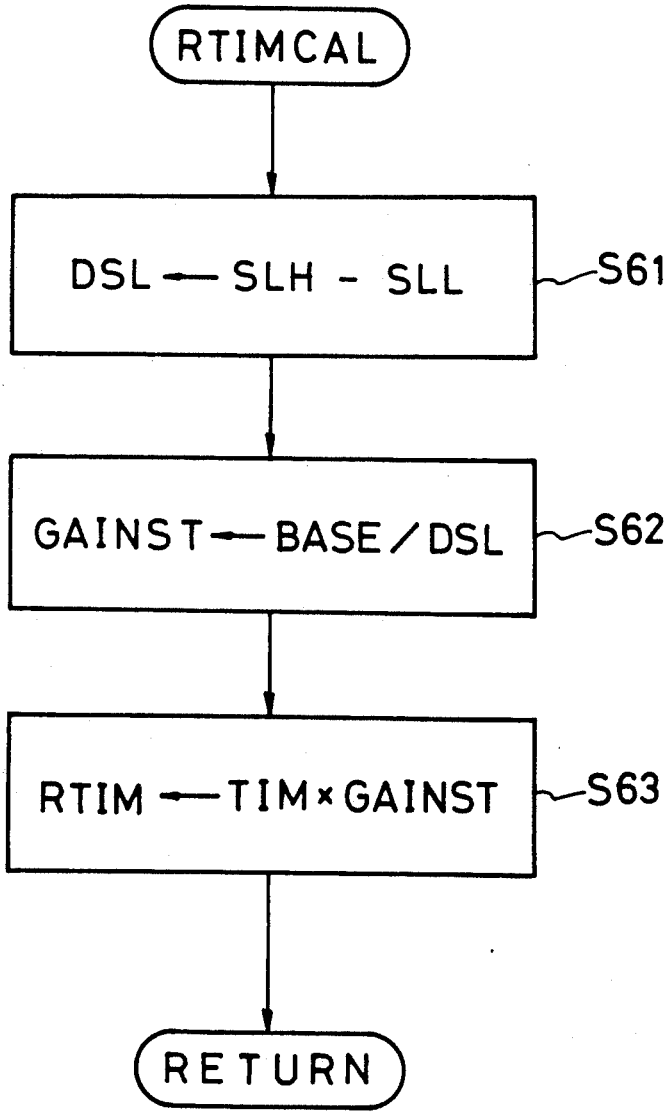
FIG. 9 is a flowchart showing correction control of a measurement result of a response time.

Processing contents of Step 34 is shown in the flowchart of FIG. 9.

In the flowchart of FIG. 9, at Step 61, a deviation between the two reference levels SLH and SLL is obtained and set at DSL.

At Step 62, the ratio of a reference interval BASE against the above actual interval DSL is set as a response time correction value GAINST.

And at Step 63, an actually measured response time TIM is corrected by multiplied by the above response time correction value GAINST, and the correction result is set at RTIM.

Explanation will be made referring back to the flowcharts of FIG. 6 to FIG. 8. After the time required to cross the reference levels SLH and SLL as the air/fuel ratio is changed from rich to lean is corrected according to the reference diagnosis level interval, as mentioned above, the above corrected response time RTIM is finally set as a response time RLTIM at change from rich to lean at Step 35.

At the next Step 36, the above flag 'MONTST' is set at 0, so that the processing from Step 33 to Step 36 should not be repeated when the output VO2 continues to fall below the reference level SLL.

Also, when it is judged that the flag 'LEVELO2' is 0 at Step 33, it means that the response time from rich to lean has not been measured, and a jump takes place to Step 36 only to reset the flag 'MONTST' to zero, and the response time RLTIM is not renewed.

At the next Step 37, the measured value TIM of the response time and the corrected measured value RTIM are both reset at zero.

Moreover, at Step 38, the flag 'LEVELO2' is reset to zero to reverse the history that the output VO2 has fallen below the reference level SLL.

Also, at Step 39, a counter LMDCOUNT for counting the number of reversion of the rich/lean judgment is reset to zero. This reversion counter LMDCOUNT is, as will be described later, to prevent misjudgment as deterioration in response when the output VO2 goes up and down within the output range surrounded by the reference levels SLH and SLL, and it is counted up every time when the output VO2 crosses the reference level corresponding to the theoretical air/fuel ratio.

Also, at Step 40, a flag 'MONTNG' is reset to zero for prohibiting monitoring of the response time based on the value of the above reversion counter LMDCOUNT.

When the air/fuel ratio is changed from the above lean state where the output VO2 falls below the reference level SLL to the rich direction and the output VO2 enters the output range surrounded by the reference levels SLH and SLL, it goes from Step 31 to Step 41.

At Step 41, judgment on the flag 'MONTST' is made, and when the above flag 'MONTST' is zero and the output VO2 enters the output range surrounded by the reference levels SLH and SLL for the first time, it goes on to Step 42.

At Step 42, judgment on the above flag 'MONTNG' is made, and if zero, it goes on to Step 43, wherein the above flag 'MONTST' is set at 1 to go to Step 45 to measure the response time TIM.

After the second time, it goes from Step 41 to Step 44, wherein judgment on the reversion counter LMDCOUNT is made. As the above reversion counter LMDCOUNT is reset at zero when the output VO2 is outside the range surrounded by the reference levels SLH and SLL, when it crosses the reference levels SLH and SLL in a certain direction, the counter does not exceed 1.

Thus, when it is judged that the reversion counter LMDCOUNT exceeds 1 at Step 44, it means that the output VO2 goes up and down in the output range surrounded by the reference levels SLH and SLL, and as the response time TIM can not be measured in this case, it goes to Step 46, wherein the flag 'MONTNG' is set at 1 so that it is judged that the response time can not be measured, and it jumps Step 45 to end the program.

In the meantime, when the output VO2 goes beyond the reference level SLH for diagnosis, the response time LRTIM from lean to rich is obtained similarly as with the explanation made on above Step 32 to Step 40 (Step 47 to Step 55).

Next, process of diagnosis based on the above response times RLTIM and LRTIM will be described referring to the flowchart of FIG. 10.

Figure 10:
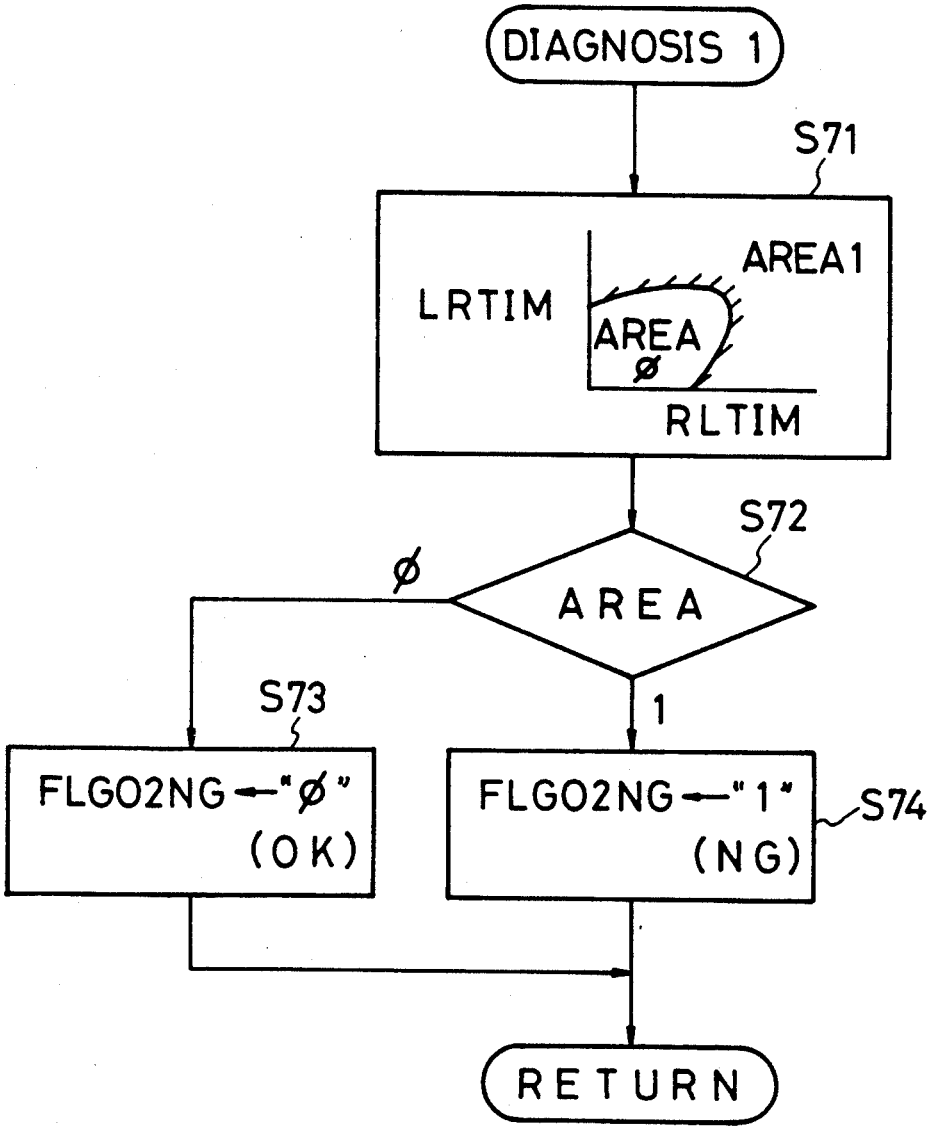
FIG. 10 is a flowchart showing a process of diagnosis based on a response time.

In the flowchart of FIG. 10, first, at Step 71, a map of a non-deterioration area (area 0) and a deterioration area (area 1) which was set in advance according to the above two response times RLTIM and LRTIM is referred to.

And at Step 72, it is judged to which one of the above two areas the combination of the actually obtained response times RLTIM and LRTIM corresponds.

When both the response times RLTIM and LRTIM are sufficiently small and corresponds to the area 0, it goes to Step 73, wherein a flag 'FLGO2NG' for setting the deterioration diagnosis result of the oxygen sensor 16 at 0, and a diagnosis is made that there is not deterioration in the oxygen sensor 16.

In the meantime, when at least one of the response times RLTIM and LRTIM is a long time exceeding an allowable level and corresponds to the area 1, it goes to Step 74, wherein the above flag 'FLGO2NG' is set at 1 to make a diagnosis that response deterioration is generated at the oxygen sensor 16.

In the above preferred embodiment, though the deterioration diagnosis is made based only on the response time which the output VO2 of the oxygen sensor 16 crosses the two reference levels SLH and SLL at reversion of the air/fuel ratio between rich and lean, diagnosis accuracy may be improved by combining the above diagnosis based on the response time with a diagnosis based on a reversion cycle between rich and lean during the feedback control.

Figure 12:
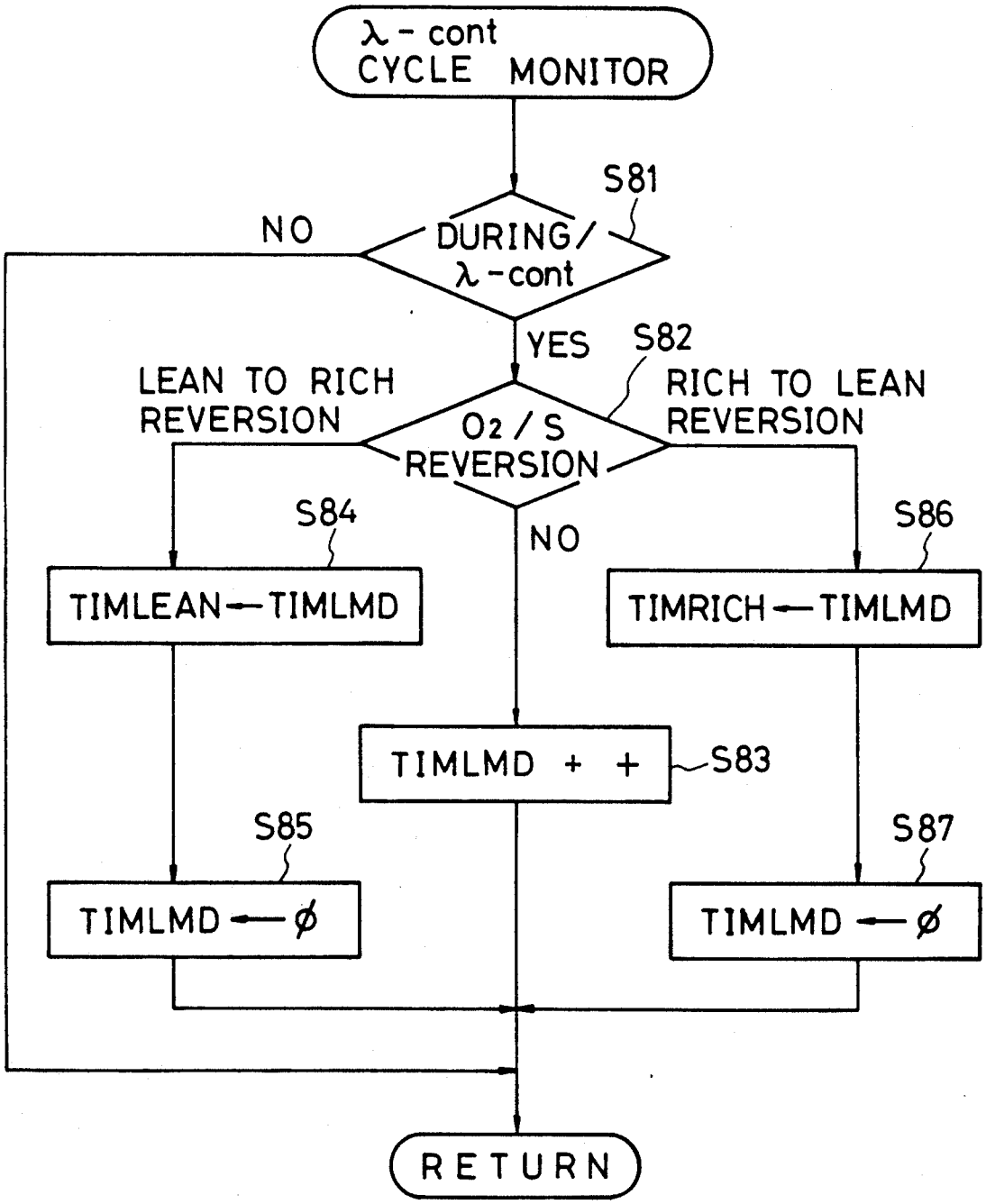
FIG. 12 is a flowchart showing measurement control of a rich/lean reversion cycle.

The program shown in the flowchart of FIG. 12 is to measure the rich/lean reversion cycle, and first, at Step 81, it is judged whether the air/fuel ratio feedback control is being executed or not.

When the air/fuel ratio feedback control is being carried out, it goes on to Step 82, wherein it is judged whether the output VO2 of the oxygen sensor 16 has crossed the reference level for rich/lean judgment and the rich/lean judgment has been reversed. When the rich/lean reversion judgment is not made, it goes on to Step 83 to count up a timer TIMLMD for measuring the reversion cycle.

In the meantime, when the rich/lean reversion is detected at Step 82, the program goes to either Step 84 or Step 86 according to the reversion direction, and the reversion time measured by the above timer TIMLMD is set at TIMLEAN at the reversion form lean to rich, while at TIMRICH at the reversion from rich to lean.

Also at the reversion, the above timer TIMLMD is reset to zero at Step 85 or Step 87, so that the time till the next reversion is measured.

Figure 6:
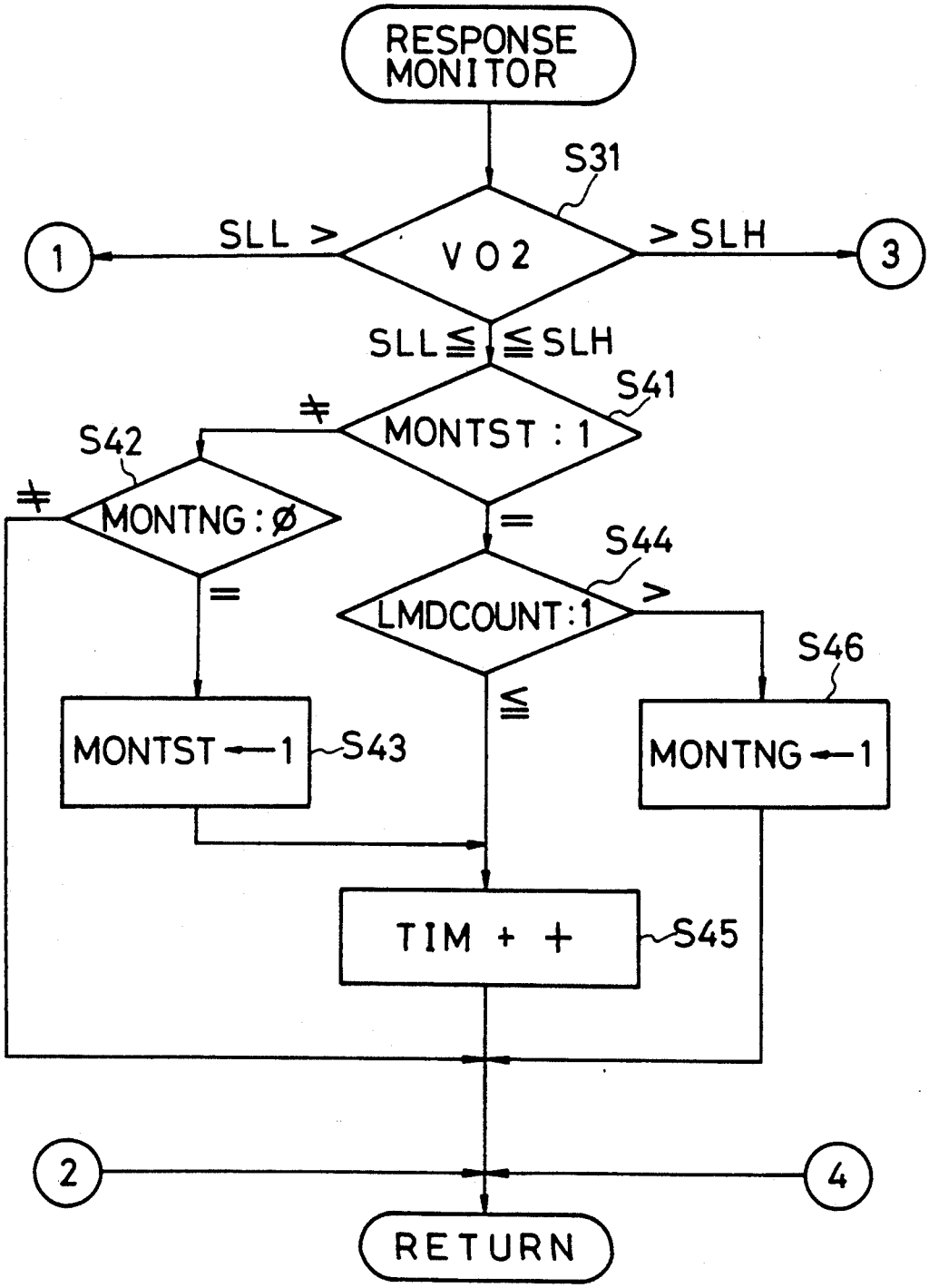
FIG. 6 is a flowchart showing measurement control of a response time.
Figure 7:
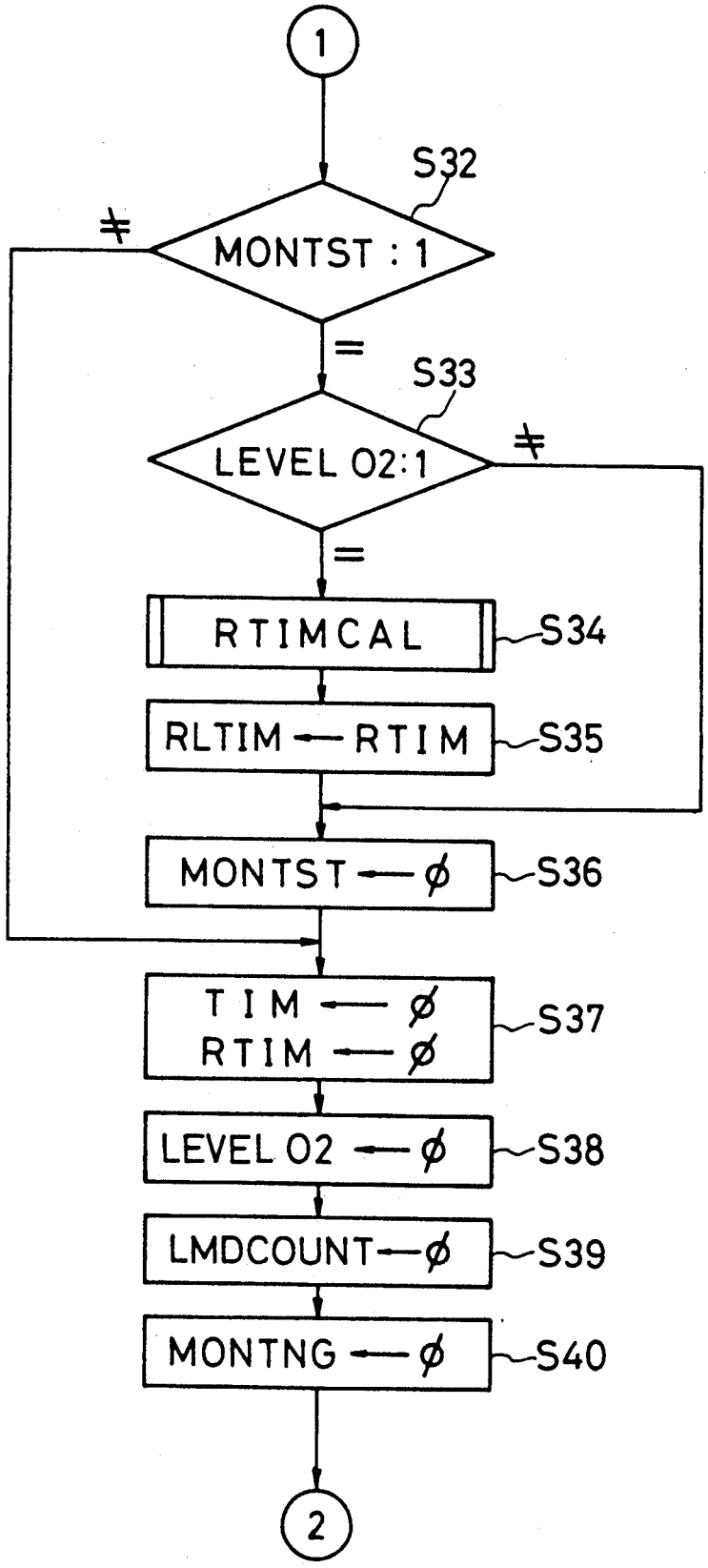
FIG. 7 is a flowchart showing measurement control of a response time.
Figure 8:
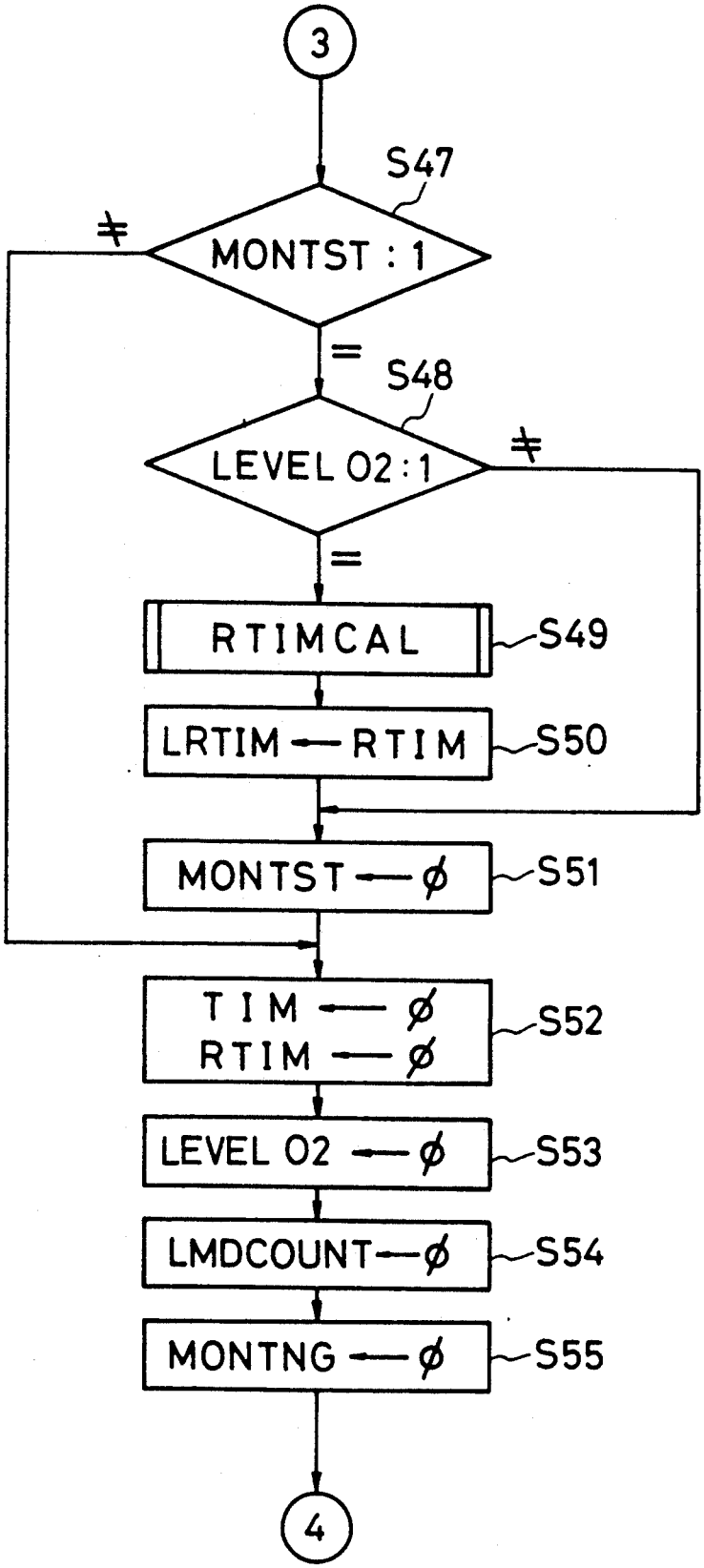
FIG. 8 is a flowchart showing measurement control of a response time.
Figure 13:
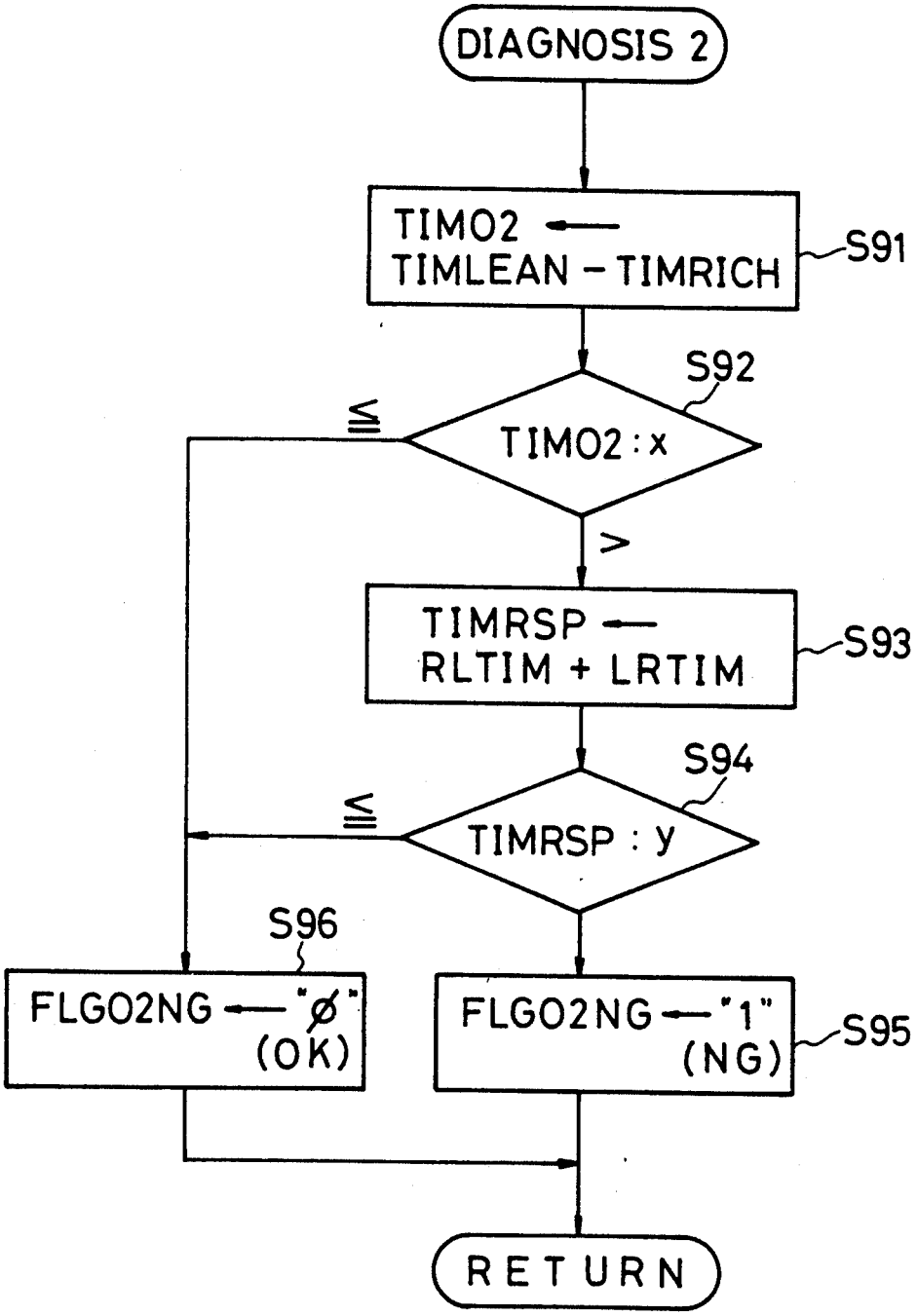
FIG. 13 is flowchart showing diagnosis based on a response time and a reversion cycle.

The program shown in the flowchart of FIG. 13 is deterioration diagnosis of the oxygen sensor 16 based on the response times RLTIM and LRTIM measured according to the flowcharts of FIG. 6 to FIG. 8 and the rich/lean reversion times TIMLEAN and TIMRICH measured according to the flowchart of FIG. 12.

Here, at Step 91, both the reversion times TIMLEAN and TIMRICH are added together and set at TIMO2 as the reversion cycle.

And at the next Step 92, the above reversion cycle TIMO2 is compared with a reference cycle x determined by the engine revolution speed and so on, and when the actual reversion cycle TIMO2 is longer than the reference cycle x, it goes on to Step 93.

At Step 93, the two response times RLTIM and LRTIM measured in each of the above different directions are added together and set at TIMRSP, and at the next Step 94, this added value TIMRSP of the response times is compared with a reference response time y, and when the actual response time is longer than the reference, it goes to Step 95, wherein the flag 'FLGO2NG' is set at 1 and deterioration of the oxygen sensor 16 is diagnosed.

In the meantime, when either one of the response time or the reversion time is at the normal level, it goes to Step 96, wherein the above flag 'FLGO2NG' is set at zero to diagnose non-deterioration of the oxygen sensor 16.

I claim:

1. A diagnosing device in an air/fuel ratio control device for internal combustion engine comprising:

an oxygen sensor provided at an exhaust system of the engine for detecting oxygen concentration in exhaust gas;

an air/fuel ratio feedback control means for feedback control of a fuel supply amount to the engine based on a detection signal from said oxygen sensor so that an air/fuel ratio of intake mixture of the engine gets close to a target air/fuel ratio;

a diagnosis level variably setting means for variably setting two different reference levels for diagnosis for measuring response time of said oxygen sensor based on a detection signal level from said oxygen sensor; and a diagnosing means for measuring time with which the detection signal of said oxygen sensor crosses the two reference levels for diagnosis set by said diagnosis level variably setting means as the response time of the oxygen sensor and for making a deterioration diagnosis of the oxygen sensor based on comparison between said measured response time and a predetermined reference time.

2. A diagnosing device in an air/fuel ratio control means for an internal combustion engine according to claim 1, wherein said diagnosis level variably setting means comprises:

a maximum/minimum value detecting means for detecting a maximum value and a minimum value of the detection signal output of said oxygen sensor;

an amplitude calculating means for calculating an amplitude of the detection signal as a deviation between the maximum value and the minimum value detected by said maximum/minimum value detecting means; and a diagnosis level calculating means for setting a value obtained by subtracting a predetermined proportion of said amplitude from the maximum value detected by said maximum/minimum value detecting means as a reference level for diagnosis on an upper side and for setting a value obtained by adding a predetermined proportion of said amplitude to the minimum value detected by said maximum/minimum value detecting means as the reference level for diagnosis on a lower side.

3. A diagnosing device in an air/fuel ratio control device for an internal combustion engine according to claim 1, wherein said diagnosing means measures response times according to direction where the detection signal from said oxygen sensor crosses said two reference levels for diagnosis, respectively, and diagnoses deterioration of the oxygen sensor based on combination of these response times.

4. A diagnosing device in an air/fuel ratio control device for an internal combustion engine according to claim 1, wherein said diagnosing means corrects said measured response times according to a ratio of an interval between the two reference levels for diagnosis set by said diagnosis level variable setting means against a reference interval, and diagnosis deterioration of said oxygen sensor based on the response time after said correction.

5. A diagnosing device in an air/fuel ratio control device for an internal combustion engine according to claim 1, wherein said diagnosing means comprises a feedback cycle measuring means for measuring a control cycle of said air/fuel ratio feedback control means, and judges generation of deterioration of the oxygen sensor only when both the control cycle measured by said feedback cycle measuring means and said measured response time show the deterioration state of said oxygen sensor.

6. A diagnosing device in an air/fuel ratio control device for an internal combustion engine according to claim 1, wherein said diagnosing means does not measure said response time when the detection signal of said oxygen sensor goes up and down within said two reference levels for diagnosis.

7. A diagnosing method in an air/fuel ratio control device for an internal combustion engine comprising:

a step for detecting oxygen concentration in engine exhaust gas by an oxygen sensor;

a step for variably setting two different reference levels for diagnosis for measuring a response time of said oxygen sensor based on a detection signal level of said oxygen sensor;

a step for measuring the response time with which a detection signal of said oxygen sensor crosses said two reference levels for diagnosis; and a step for making a deterioration diagnosis of the oxygen sensor based on comparison between said measured response time and a predetermined reference time.

8. A diagnosing method in an air/fuel ratio control device for an internal combustion engine according to claim 7, wherein said step for variably setting said two reference levels for diagnosis comprises:

a step for detecting a maximum value and a minimum value of the detection signal output of the oxygen sensor;

a step for calculating an amplitude of the detection signal as a deviation between said detected maximum value and minimum value; and a step for setting a value obtained by subtracting a predetermined proportion of said amplitude from said detected maximum value as the reference level for diagnosis on an upper side and for setting a value obtained by adding a predetermined proportion of said amplitude to said detected minimum value as the reference level for diagnosis on a lower side.

9. A diagnosing method in an air/fuel ratio control device for an internal combustion engine according to claim 7, wherein said step for measuring said response time measures response times according to direction where the detection signal from said oxygen sensor crosses said two reference levels for diagnosis, respectively, and said step for making said deterioration diagnosis diagnoses deterioration of the oxygen sensor based on combination of these response times.

10. A diagnosing method in an air/fuel ratio control device for an internal combustion engine according to claim 7, wherein said step for making said deterioration diagnosis corrects said measured response time according to a ratio of an interval between said two reference levels for diagnosis against a reference interval and makes a deterioration diagnosis of said oxygen sensor based on said corrected response time.

11. A diagnosing method in an air/fuel ratio control device for an internal combustion engine according to claim 7, wherein said step for making said deterioration diagnosis includes a step for measuring a control cycle in a feedback control of said fuel supply amount, and judges generation of deterioration of the oxygen sensor only when both said measured control cycle and said measured response time show the deterioration state of said oxygen sensor.

12. A diagnosing method in an air/fuel ratio control device for an internal combustion engine according to claim 7, wherein said step for measuring said response time does not measure said response time when the detection signal of said oxygen sensor goes up and down within said two reference levels for diagnosis.

* * * * *